US009502837B2

(12) United States Patent
Kao et al.

(10) Patent No.: US 9,502,837 B2
(45) Date of Patent: Nov. 22, 2016

(54) ELECTRICAL PLUG CONNECTOR AND ELECTRICAL RECEPTACLE CONNECTOR

(71) Applicant: ADVANCED-CONNECTEK INC., New Taipei (TW)

(72) Inventors: Ya-Fen Kao, New Taipei (TW); Yu-Lun Tsai, New Taipei (TW); Pin-Yuan Hou, New Taipei (TW); Wen-Yu Wang, New Taipei (TW); Wen-Hsien Tsai, New Taipei (TW); Chung-Fu Liao, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 14/713,463

(22) Filed: May 15, 2015

(65) Prior Publication Data

US 2015/0333451 A1 Nov. 19, 2015

(30) Foreign Application Priority Data

May 15, 2014 (TW) ..... 103208542 U
Oct. 17, 2014 (TW) ..... 103136076 A

(51) Int. Cl.

| | |
|---|---|
| ***H01R 24/60*** | (2011.01) |
| ***H01R 13/6596*** | (2011.01) |
| ***H01R 13/6581*** | (2011.01) |
| ***H01R 13/6597*** | (2011.01) |
| ***H01R 12/72*** | (2011.01) |
| *H01R 107/00* | (2006.01) |

(52) U.S. Cl.

CPC ..... *H01R 24/60* (2013.01); *H01R 12/724* (2013.01); *H01R 13/6581* (2013.01); *H01R 13/6596* (2013.01); *H01R 13/6597* (2013.01); *H01R 2107/00* (2013.01)

(58) Field of Classification Search

USPC ..... 439/607.01, 607.41, 676, 660, 327, 439/358, 557

See application file for complete search history.

(56) References Cited

U.S. PATENT DOCUMENTS

| | | | | |
|---|---|---|---|---|
| 6,056,578 | A * | 5/2000 | Lin | 439/358 |
| 6,234,828 | B1 * | 5/2001 | Kuo | 439/358 |
| 6,322,387 | B2 * | 11/2001 | Kawamae et al. | 439/358 |
| 6,709,286 | B1 * | 3/2004 | Korsunsky | H01R 13/743 439/557 |
| 7,390,220 | B1 * | 6/2008 | Wu | 439/607.06 |

(Continued)

FOREIGN PATENT DOCUMENTS

| | | |
|---|---|---|
| CN | 201663255 U | 12/2010 |
| CN | 203481453 U | 3/2014 |

*Primary Examiner* — Alexander Gilman

(74) *Attorney, Agent, or Firm* — Muncy, Geissler, Olds & Lowe, P.C.

(57) ABSTRACT

An electrical plug connector includes an insulation housing, a metal shell and plural buckling members. The insulation housing includes an insertion cavity, plural lateral sides and plural assembling spaces. The insertion cavity is disposed at a front portion of the insulation housing. The lateral sides are disposed at two sides of the insulation housing. The assembling spaces are disposed at the lateral sides and communicate with the insertion cavity. The metal shell encloses the insulation housing. The buckling members are respectively disposed in the assembling spaces and each includes a arm portion, a hook portion and a soldering portion. The arm portion is disposed in the assembling portion, the hook portion is extended from a front portion of the arm portion toward the insertion cavity, and the soldering portion is extended from a rear portion of the arm portion and exposed out of the assembling space.

19 Claims, 18 Drawing Sheets

(56) References Cited

U.S. PATENT DOCUMENTS

| | | | | |
|---|---|---|---|---|
| 7,462,071 | B1 * | 12/2008 | Wu | 439/607.05 |
| 7,510,421 | B2 * | 3/2009 | Fransen | H01R 9/2416 439/449 |
| 7,758,374 | B2 * | 7/2010 | Yu et al. | 439/493 |
| 8,123,566 | B2 * | 2/2012 | Liu et al. | 439/630 |
| 8,408,932 | B2 * | 4/2013 | Villarreal et al. | 439/358 |
| 8,556,648 | B2 * | 10/2013 | Wu | 439/367 |
| 8,708,580 | B2 * | 4/2014 | Wu | 385/93 |
| 8,708,718 | B2 * | 4/2014 | Li et al. | 439/108 |
| 8,900,013 | B2 * | 12/2014 | Li et al. | 439/660 |
| 9,147,979 | B1 * | 9/2015 | Chung et al. | |
| 9,178,310 | B2 * | 11/2015 | Tsai | |
| 2005/0186830 | A1 * | 8/2005 | Wu | 439/358 |
| 2006/0019526 | A1 * | 1/2006 | Jeon | 439/358 |
| 2006/0121783 | A1 * | 6/2006 | Wu et al. | 439/607 |
| 2010/0210124 | A1 * | 8/2010 | Li | 439/108 |
| 2013/0115823 | A1 * | 5/2013 | Wu et al. | 439/660 |
| 2013/0130548 | A1 * | 5/2013 | Wu et al. | 439/607.01 |
| 2013/0130549 | A1 * | 5/2013 | Wu et al. | 439/607.01 |
| 2015/0244111 | A1 * | 8/2015 | Ju et al. | 439/607.01 |
| 2015/0244118 | A1 * | 8/2015 | Lin et al. | 439/660 |

* cited by examiner

300

| | | | | | | | | | | | |
|---|---|---|---|---|---|---|---|---|---|---|---|
| GND | RX2+ | RX2− | VBUS | RFU | D− | D+ | CC1 | VBUS | TX1− | TX1+ | GND |
| GND | TX2+ | TX2− | VBUS | CC2 | D+ | D− | RFU | VBUS | RX1− | RX1+ | GND |

151

152

FIG. 4C

| | | | | | | | | | | | | | |
|---|---|---|---|---|---|---|---|---|---|---|---|---|---|
| GND | TX1+ | TX1− | VBUS | CC1 | D+ | D− | RFU | VBUS | RX2− | RX2+ | GND | 28 |
| GND | RX1+ | RX1− | VBUS | RFU | D− | D+ | CC2 | VBUS | TX2− | TX2+ | GND | 29 |

FIG. 7D

ELECTRICAL PLUG CONNECTOR AND ELECTRICAL RECEPTACLE CONNECTOR

CROSS-REFERENCES TO RELATED APPLICATIONS

This non-provisional application claims priority under 35 U.S.C. §119(a) on Patent Application No. 103208542 and 103136076, filed in Taiwan, R.O.C. on 2014 May 15 and 2014 Oct. 17, the entire contents of which are hereby incorporated by reference.

FIELD OF THE INVENTION

The disclosure relates to an electrical connector, and particularly to an electrical plug connector and an electrical receptacle connector.

BACKGROUND OF THE INVENTION

Current electrical devices have multiple functions to provide significant convenience for people; however, electromagnetic waves which interfere with the functions and the signal transmissions of the electrical devices, are generated upon operating the electrical devices; for example, electromagnetic interference (EMI) or radio frequency interference (RFI).

USB, universal serial bus, is a common electrical connector interface applied to electrical devices; the USB 2.0 interfaces have been further developed to achieve faster USB 3.0 interfaces.

The conventional USB electrical receptacle connector and the conventional USB electrical plug connector induce signal interference, such as EMI, RFI, etc., upon transmitting signals, resulting in reduction of signal transmission quality. Therefore, improving the structure of the conventional electrical connector is an urgent matter for person skilled in the art to address.

SUMMARY

In view of this, the disclosure provides an electrical plug connector including a metal shell, an insulation housing, a plurality of upper-row elastic terminals, a plurality of lower-row elastic terminals and a plurality of buckling members. The metal shell has an accommodating cavity. The insulation housing is received in the accommodating cavity and includes an upper portion, a lower portion, an insertion cavity and a plurality of lateral sides. The insertion cavity is defined between the upper portion and the lower portion. The lateral sides are disposed at two sides of the insulation housing, respectively. The upper-row elastic terminals include a plurality of upper-row elastic signal terminals, at least one upper-row elastic power-supply terminal and at least one upper-row elastic ground terminal, and each of the upper-row elastic terminals is disposed at the insulation housing and located at a lower surface of the upper portion. The lower-row elastic terminals include a plurality of lower-row elastic signal terminals, at least one lower-row elastic power-supply terminal and at least one lower-row elastic ground terminal, and each of the lower-row elastic terminals is disposed at the insulation housing and located at an upper surface of the lower portion. The buckling members are disposed at the insulation housing. Each of the buckling members includes a arm portion, a hook portion and a soldering portion. The arm portion is disposed in the lateral side after the insulation housing is formed. The hook portion is extended from a front portion of the arm portion toward the insertion cavity. The soldering portion is extended from a rear portion of the arm portion and exposed out of the insulation housing.

The disclosure further provides an electrical plug connector including a metal shell, an insulation housing, a plurality of upper-row elastic terminals, a plurality of lower-row elastic terminals and a plurality of buckling members. The metal shell has an accommodating cavity. The insulation housing is received in the accommodating cavity and insulation housing includes an upper portion, a lower portion, an insertion cavity, a plurality of lateral sides and a plurality of assembling spaces. The insertion cavity is defined between the upper portion and the lower portion. The lateral sides are disposed at two sides of the insulation housing. The assembling spaces are disposed at the lateral sides, respectively. The assembling spaces communicate with the insertion cavity. The upper-row elastic terminals include a plurality of upper-row elastic signal terminals, at least one upper-row elastic power-supply terminal and at least one upper-row elastic ground terminal, and each of the upper-row elastic signal terminals is disposed at the insulation housing and located at a lower surface of the upper portion. The lower-row elastic terminals include a plurality of lower-row elastic signal terminals, at least one lower-row elastic power-supply terminal and at least one lower-row elastic ground terminal, and each of the lower-row elastic terminals is disposed at the insulation housing and located at an upper surface of the lower portion. The buckling members are respectively disposed at the lateral sides of the insulation housing. Each of the buckling members includes a arm portion, a hook portion and a soldering portion. The arm portion is disposed in the assembling space. The hook portion is extended from a front portion of the arm portion toward the insertion cavity, and the soldering portion is extended from a rear portion of the arm portion and exposed out of the assembling space.

The disclosure also provides an electrical receptacle connector including a metal shell, an insulation housing, a plurality of upper-row plate terminals, a plurality of lower-row plate terminals and a grounding sheet. The metal shell has a receiving cavity. The insulation housing is received in the receiving cavity and insulation housing includes a base portion and a tongue portion extended from one side of the base portion. The tongue portion includes an upper surface and a lower surface. The upper-row plate terminals include a plurality of upper-row plate signal terminals, at least one upper-row plate power-supply terminal and at least one upper-row plate ground terminal, and each of the upper-row plate terminals is disposed at the base portion and the tongue portion and located at the upper surface. The lower-row plate terminals include a plurality of lower-row plate signal terminals, at least one lower-row plate power-supply terminal and at least one lower-row plate ground terminal, and each of the lower-row plate terminals is disposed at the base portion and the tongue portion and located at the lower surface. The grounding sheet is disposed at the insulation housing and includes a main body, a plurality of buckles and a plurality of soldering portions. The main body is disposed at the tongue portion. The buckles are disposed at two sides of the main body to be exposed out of two sides of the tongue portion. The buckles are respectively connected to the hook portions of the electrical plug connector. The soldering portions are respectively disposed at a rear portion of the main body.

As above, in the electrical plug connector of the disclosure, the arm portions are connected to the metal shell, and the soldering portions of the buckling members are connected to one circuit board; while in the electrical receptacle connector of the disclosure, the soldering portions of the grounding sheet are connected to another circuit board. Consequently, low-impedance grounding path can be provided upon the electrical plug connector being connected with the electrical receptacle connector, thereby reducing the EMI and RMI problems. Additionally, the soldering portions of the buckling members are soldered on the circuit board to provide the structural strength of the buckling members. Additionally, because the upper-row terminals and the lower-row terminals are arranged upside down, and the arrangement sequence of the upper-row plate contacts are left-right reversal with respect to the arrangement sequence of the lower-row plate contacts, an electrical plug connector is inserted into the interior of the electrical receptacle connector with the terminals of the electrical plug connector contacting with the upper-row plate contacts when plugged in a forward orientation, and the electrical plug connector is inserted into the interior of the electrical receptacle connector with the terminals of the electrical plug connector contacting with the lower-row plate contacts when plugged in a reverse direction. Consequently, the inserting orientation of the electrical plug connector is not limited.

The detailed features and advantages of the disclosure are described below in great detail through the following embodiments, the content of which is sufficient for those skilled in the art to understand the technical content of the disclosure and to implement the disclosure there accordingly. Based upon the content of the specification, the claims, and the drawings, those skilled in the art can easily understand the relevant objectives and advantages of the disclosure.

BRIEF DESCRIPTION OF THE DRAWINGS

The disclosure will become more fully understood from the detailed description given herein below for illustration only and thus not limitative of the disclosure, wherein:

FIG. 4C is a schematic configuration diagram of plug terminals of the electrical plug connector shown in FIG. 4B;

FIG. 7D is a schematic configuration diagram of receptacle terminals of the electrical receptacle connector;

DETAILED DESCRIPTION

Figure 1:
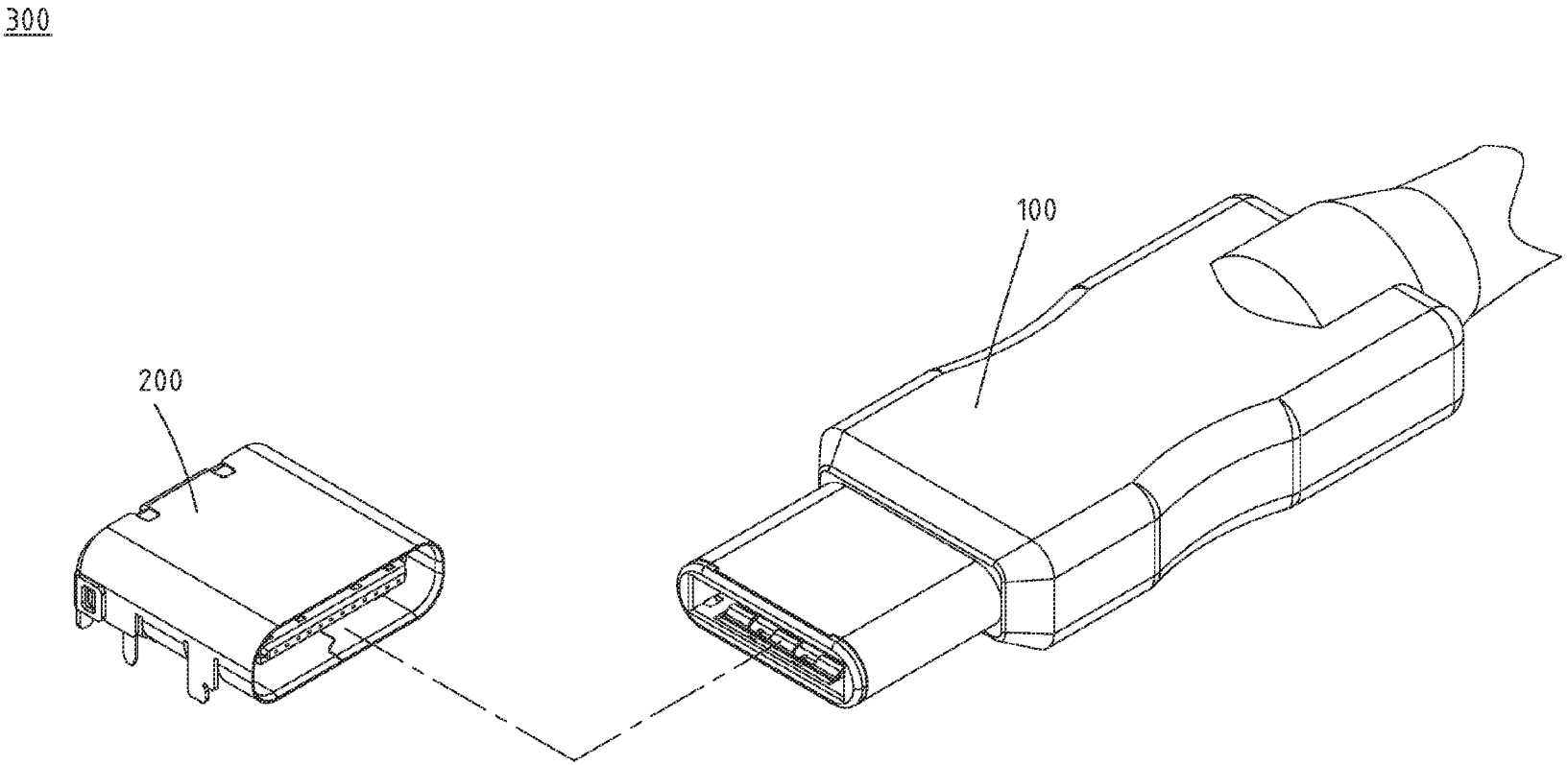
FIG. 1 is an exploded view showing an electrical plug connector and an electrical receptacle connector of an electrical connector assembly of the disclosure.
Figure 2:
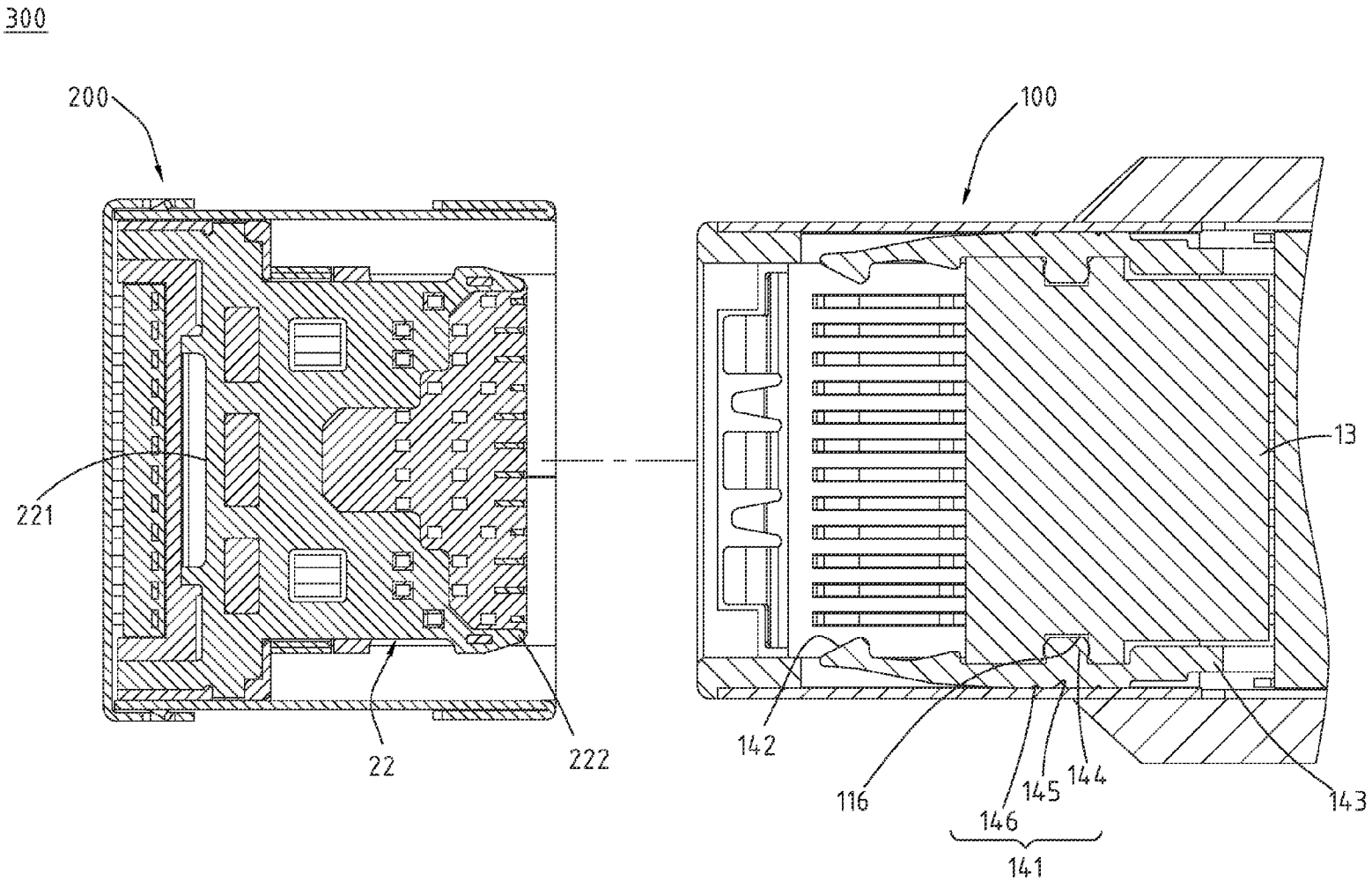
FIG. 2 is a top sectional view showing the electrical plug connector is detached from the electrical receptacle connector.
Figure 3:
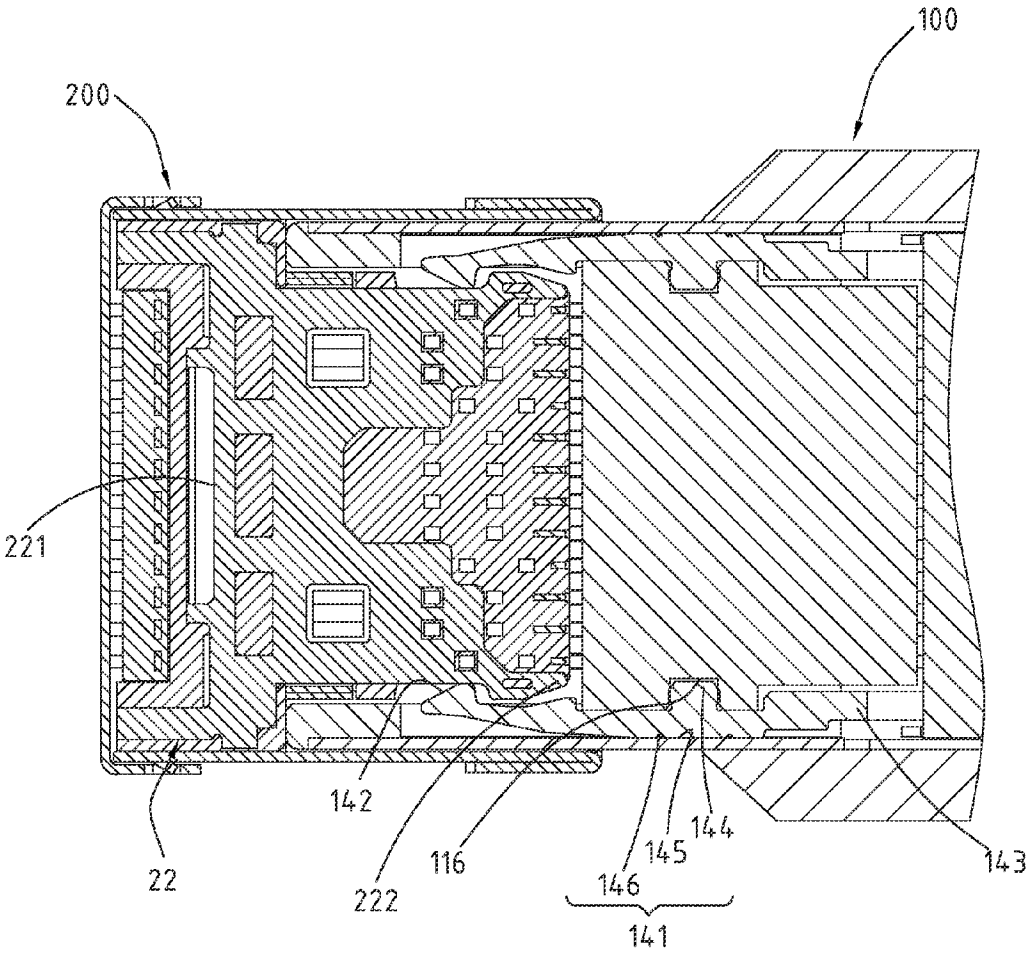
FIG. 3 is a top sectional view showing the electrical plug connector is assembled with the electrical receptacle connector.

Please refer to FIG. 1, FIG. 2 and FIG. 3, in which an electrical connector assembly 300 of the disclosure is illustrated; FIG. 1 is an exploded view showing an electrical plug connector 100 and an electrical receptacle connector 200 of the electrical connector assembly 300, and FIG. 2 and FIG. 3 are top sectional views respectively showing the electrical plug connector 100 is detached from or assembled with the electrical receptacle connector 200. The electrical connector assembly 300 includes an electrical plug connector 100 and an electrical receptacle connector 200.

Figure 4:
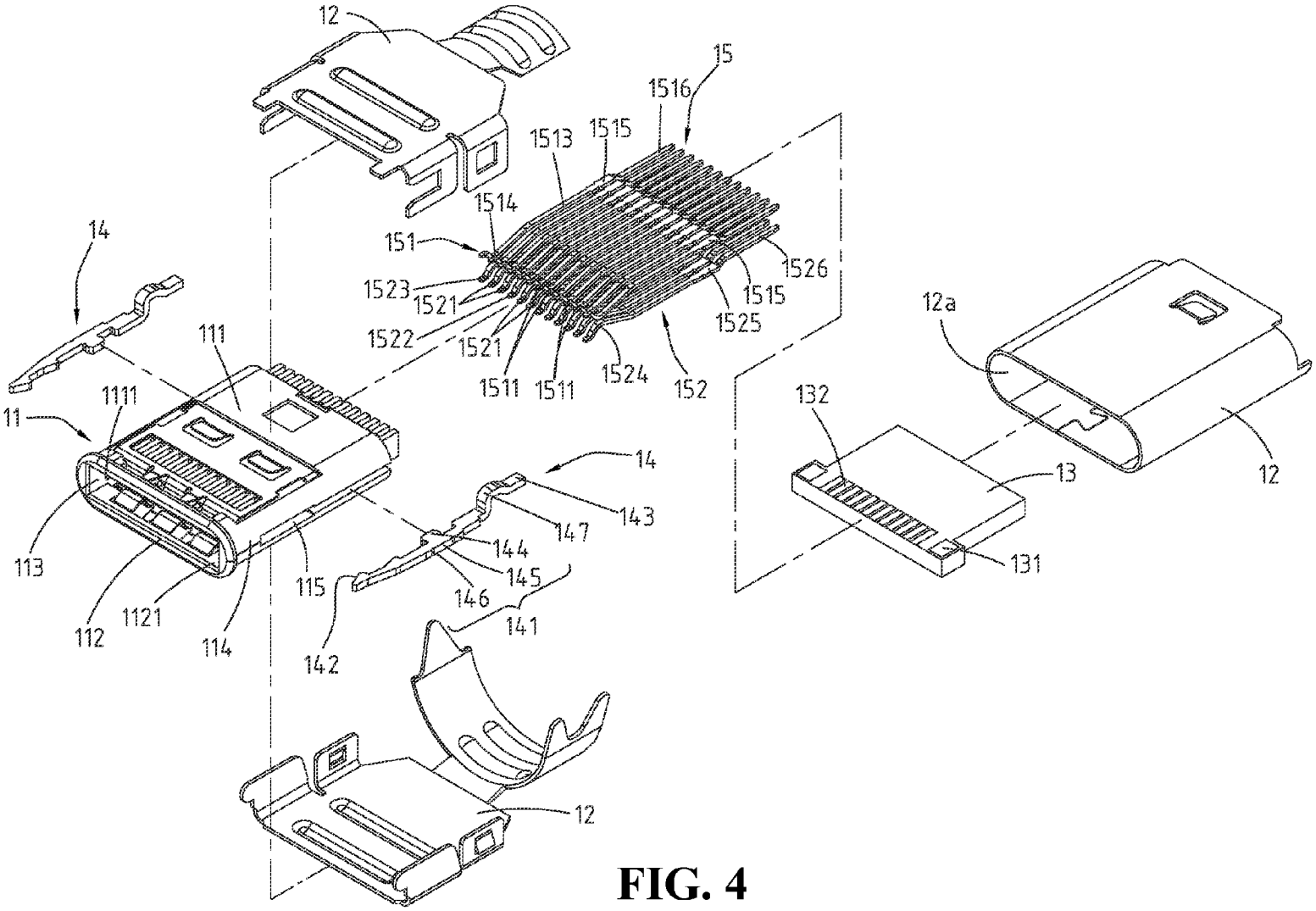
FIG. 4 is an exploded view (1) of the electrical plug connector of the disclosure.
Figure 5:
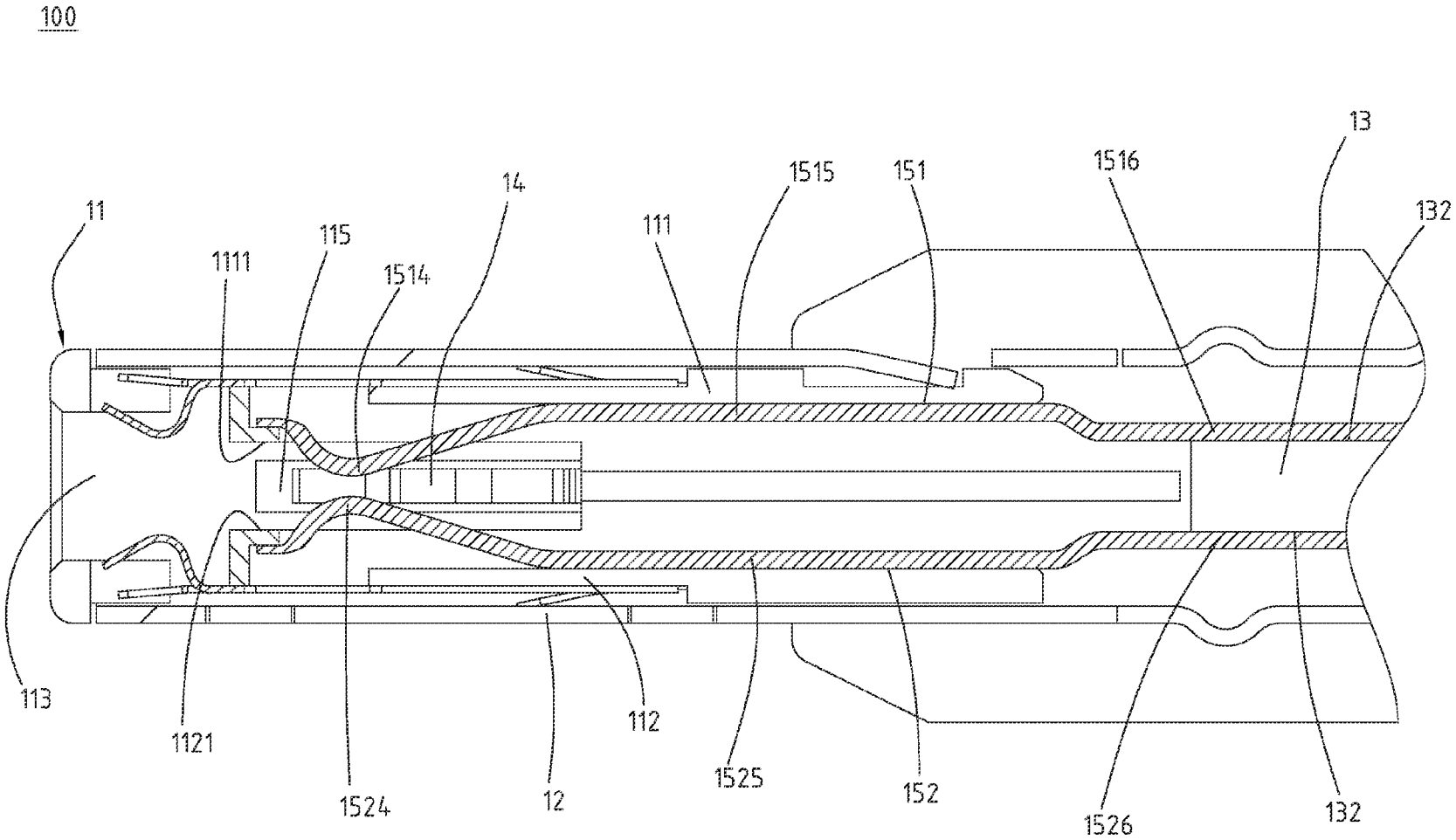
FIG. 5 is a lateral view of the electrical plug connector of the disclosure while the metal shell is eliminated from the electrical plug connector.
Figure 6:
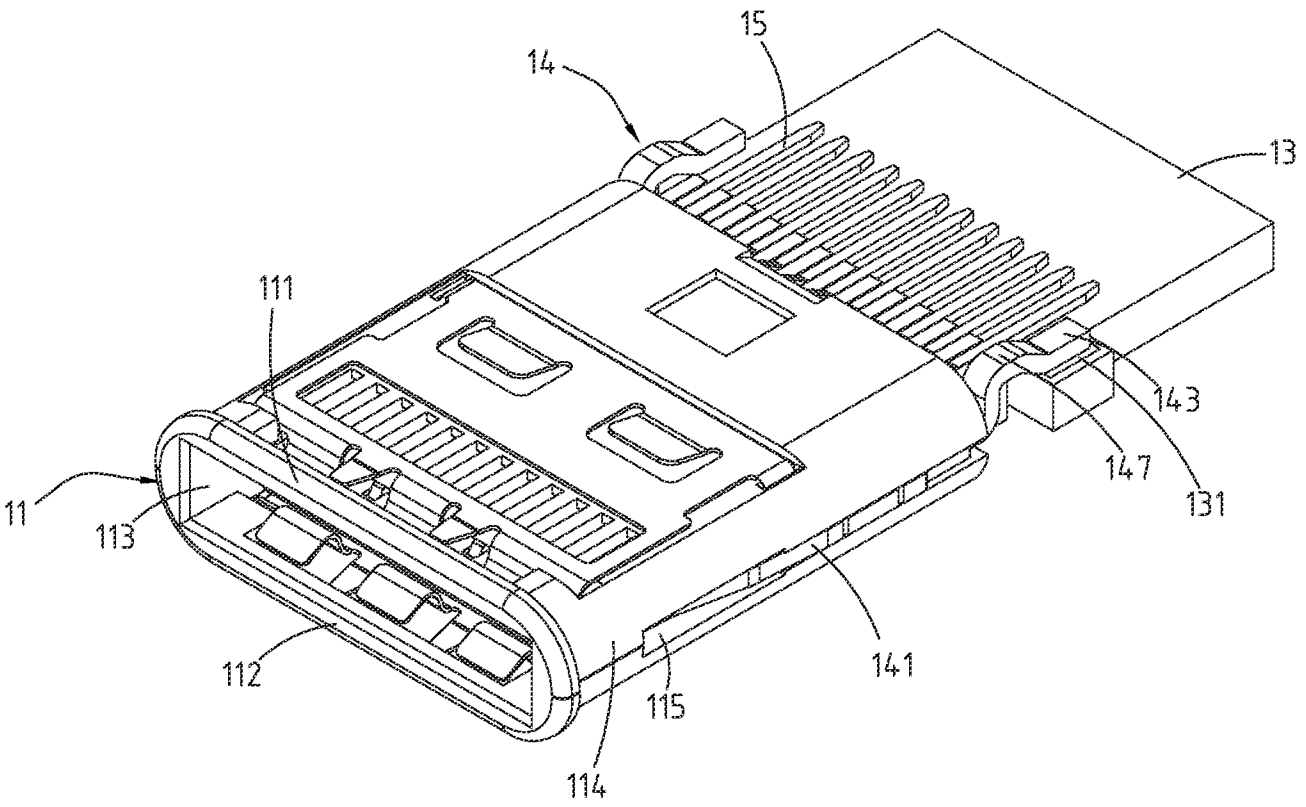
FIG. 6 is a perspective view of the electrical plug connector of the disclosure while the metal shell is eliminated from the electrical plug connector.

Please refer to FIG. 4, FIG. 5 and FIG. 6, in which an electrical plug connector 100 of a first embodiment of the disclosure is illustrated. FIG. 4 is an exploded view (1) of the electrical plug connector 100, FIG. 5 is a lateral view of the electrical plug connector 100 of the disclosure while the metal shell 12 is eliminated from the electrical plug connector 100, and FIG. 6 is a perspective view of the electrical plug connector 100 of the disclosure while the metal shell 12 is eliminated from the electrical plug connector 100. The electrical plug connector 100 is a USB type-C interface. In this embodiment, the electrical plug connector 100 includes an insulation housing 11, a metal shell 12, a circuit board 13, a plurality of buckling members 14 and a plurality of plug terminals 15.

Please refer to FIG. 4 and FIG. 5, in which the insulation housing 11 is an elongated plate. The insulation housing 11 includes an upper portion 111, a lower portion 112, an insertion cavity 113, a plurality of lateral sides 114 and a plurality of assembling spaces 115. Here, the upper portion 111 and the lower portion 112 are formed by insert molding. The insertion cavity 113 is disposed at a front portion of the insulation housing 11; that is, the insertion cavity 113 is defined between the upper portion 111 and the lower portion 112. Furthermore, the upper portion 111 has a lower surface 1111, and the lower portion 112 has an upper surface 1121; the lower surface 1111 of the upper portion 111 corresponds to the upper surface 1121 of the lower portion 112. The lateral sides 114 are disposed at two sides of the insulation housing 11. The assembling spaces 115 are elongated groove structures and respectively disposed at the lateral sides 114. A front end of each of the assembling spaces 115 is opened and communicates with the insertion cavity 113; that is, the front ends of the assembling spaces 115 are adjacent to the insertion cavity 113 and respectively communicate with the insertion cavity 113, and rear ends of the assembling spaces 115 are adjacent to two sides of the circuit board 13.

The plug terminals 15 are disposed at the upper portion 111 and the lower portion 112. The plug terminals 15 include a plurality of upper-row elastic terminals 151 and a plurality of lower-row elastic terminals 152.

Figure 4A:
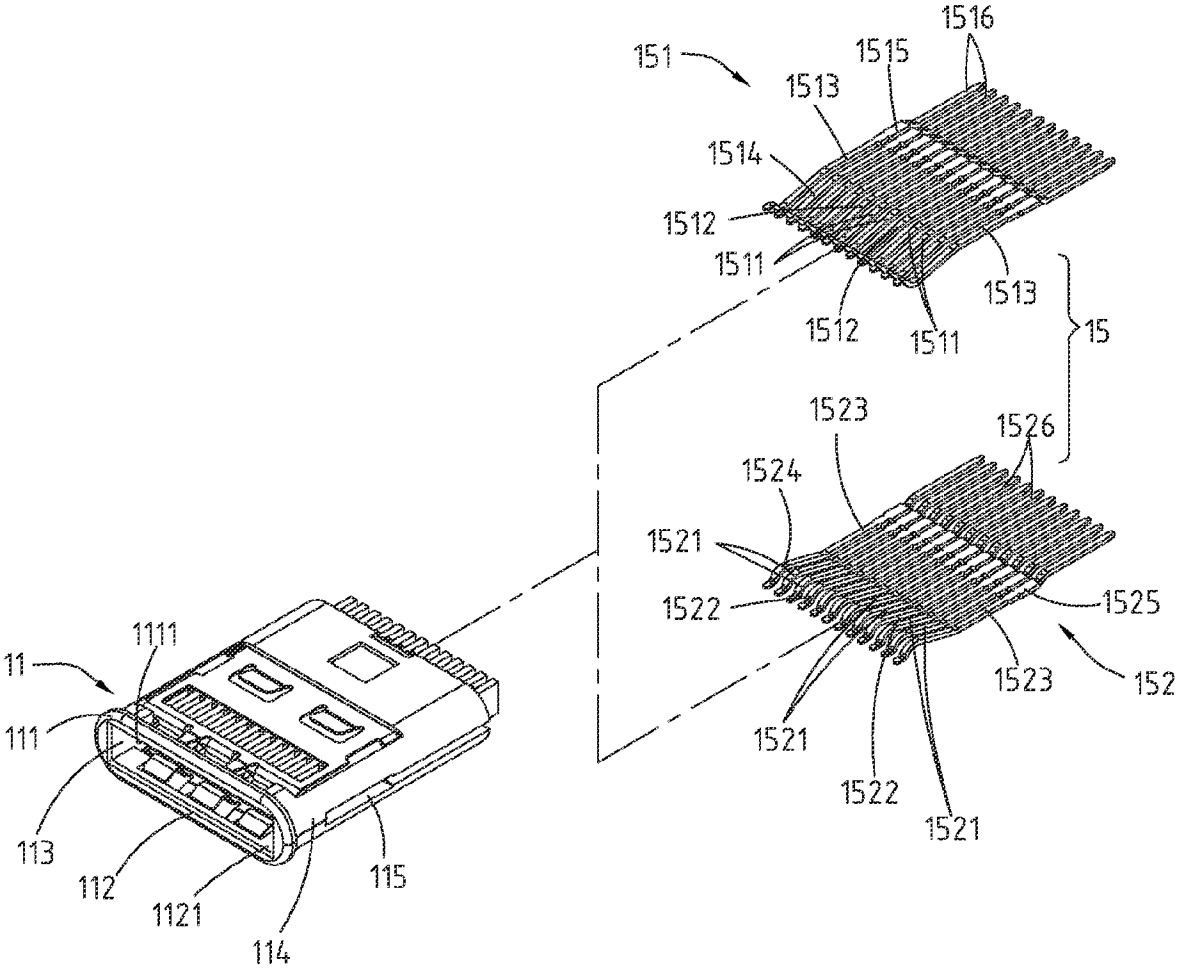
FIG. 4A is an exploded view (2) of the electrical plug connector of the disclosure while the metal shell is eliminated from the electrical plug connector.
Figure 4B:
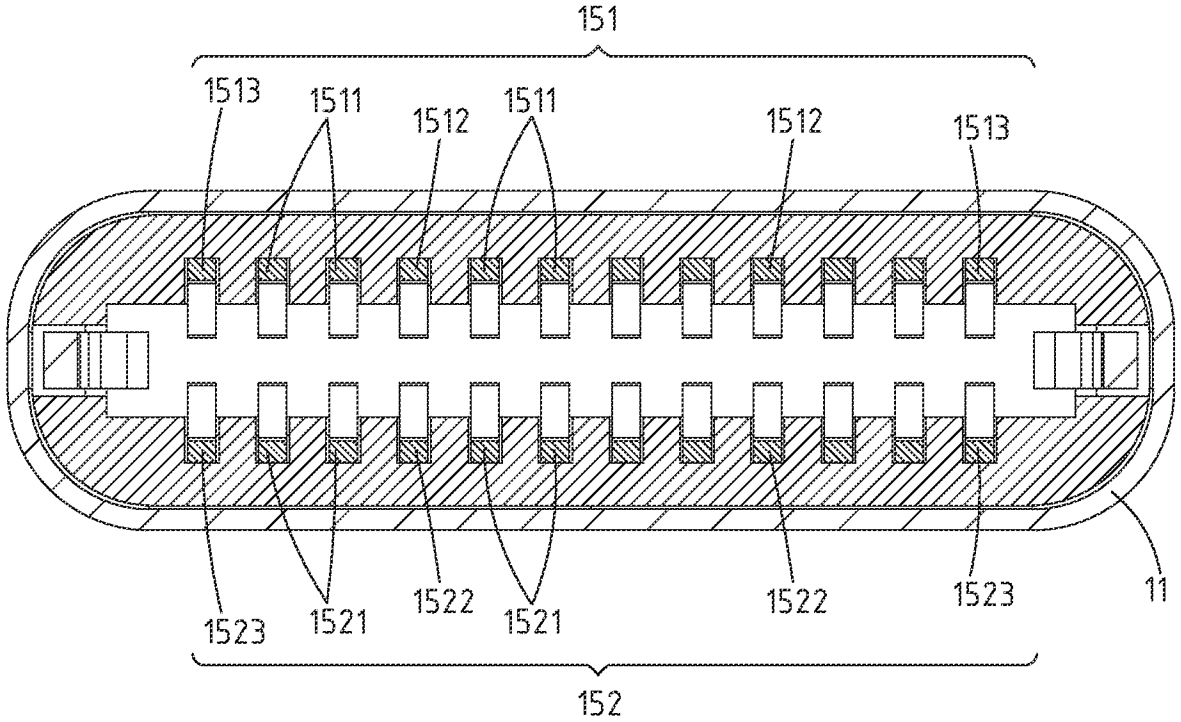
FIG. 4B is lateral sectional view of the electrical plug connector of the disclosure.

Please refer to FIG. 4A, FIG. 4B and FIG. 4C; FIG. 4A is an exploded view (2) of the electrical plug connector 100 of the disclosure while the metal shell 12 is eliminated from the electrical plug connector 100; FIG. 4B is lateral sectional view of the electrical plug connector 100 of the disclosure; FIG. 4C is a schematic configuration diagram of plug terminals 15 of the electrical plug connector 100 shown in FIG. 4B. In this embodiment, the upper-row elastic terminals 151 include a plurality of upper-row elastic signal terminals 1511, at least one upper-row elastic power-supply terminal 1512 and at least one upper-row elastic ground terminal 1513. Each of the upper-row elastic terminals 151 is disposed at the insulation housing 11 and located at the lower surface 1111 of the upper portion 111. Referring to FIG. 4C, the upper-row elastic terminals 151 include, from left to right, an upper-row elastic ground terminal 1513 (Gnd), a first pair of differential signal terminals (TX1+−), a second pair of differential signal terminals (D+−), and a third pair of differential signal terminals (RX2+−) of the upper-row elastic signal terminals 1511, upper-row elastic power-supply terminals 1512 (Power/VBUS) between the three pairs of differential signal terminals, a retain terminal (RFU), (the retain terminal and a configuration channel 1 (CC1) are respectively arranged between the upper-row elastic power-supply terminals 1512 and the second pair of differential signal terminals of the upper-row elastic signal terminals 1511), and another upper-row elastic ground terminal 1513 (Gnd).

Please refer to FIG. 4A, FIG. 4B and FIG. 4C, in which each of the upper-row elastic terminals 151 includes an upper-row contact section 1514, an upper-row connecting section 1515 and an upper-row soldering section 1516. The upper-row connecting section 1515 is disposed at the upper portion 111. The upper-row contact section 1514 is extended from one of two ends of the upper-row connecting section 1515 and disposed at the lower surface 1111 of the upper portion 111, the upper-row soldering section 1516 is extended from the other end of the upper-row connecting section 1515 and extended out of the insulation housing 11. The upper-row elastic signal terminals 1511 are extended toward the insertion cavity 113 and transmitting first signals (that is, transmitting specifications conformed to USB 3.0 signals). The upper-row soldering section 1516 is extended from a rear portion of the insulation housing 11. Furthermore, the upper-row soldering section 1516 is bent horizontally, as shown in FIG. 4A.

Please refer to FIG. 4A, FIG. 4B, and FIG. 4C; in which the lower-row elastic terminals 152 are disposed at the insulation housing 11 and located at the upper surface 1121 of the lower portion 112. In this embodiment, the lower-row elastic terminals 152 includes a plurality of lower-row elastic signal terminals 1521, at least one lower-row elastic power-supply terminal 1522 and at least one lower-row elastic ground terminal 1523. Refer to FIG. 4C, the lower-row elastic terminals 152 include, from left to right, a lower-row elastic ground terminal 1523 (Gnd), a first pair of differential signal terminals (TX2+−), a second pair of differential signal terminals (D+−), and a third pair of differential signal terminals (RX1+−) of the lower-row elastic signal terminals 1521, lower-row elastic power-supply terminals 1522 (Power/VBUS) between the three pairs of differential signal terminals, a retain terminal (RFU), (the retain terminal and a configuration channel 2 (CC2) are respectively arranged between the lower-row elastic power-supply terminals 1522 and the second pair of differential signal terminals of the lower-row elastic signal terminals 1521), and another lower-row elastic ground terminal 1523 (Gnd).

Please refer to FIG. 4A, FIG. 4B and FIG. 4C again, in which each of the lower-row elastic terminals 152 includes a lower-row contact section 1524, a lower-row connecting section 1525 and a lower-row soldering section 1526. The lower-row connecting section 1525 is disposed at the lower portion 112. The lower-row contact section 1524 is extended from one of two ends of the lower-row connecting section 1525 and disposed at the upper surface 1121 of the lower portion 112, and the lower-row soldering section 1526 is extended from the other end of the lower-row connecting section 1525 and extended out of the insulation housing 11. The lower-row elastic signal terminals 1521 are extended toward the insertion cavity 113 for transmitting second signals (that is, transmitting specifications conformed to USB 3.0 signals). The lower-row soldering section 1526 is extended from the rear portion of the insulation housing 11, provided to be aligned horizontally, as shown in FIG. 4A.

Please refer to FIG. 4A, FIG. 4B and FIG. 4C, in which embodiment the upper-row elastic terminals 151 and the lower-row elastic terminals 152 are respectively disposed at the lower surface 1111 of the upper portion 111 and the upper surface 1121 of the lower portion 112. Furthermore, the upper-row elastic terminals 151 and the lower-row elastic terminals 152 are point-symmetrical with a central point of the accommodating cavity 12*a* as the symmetrical center. Here, point-symmetry means, after the upper-row elastic terminals 151 (or the lower-row elastic terminals 152) are rotated by 180 degrees with the symmetrical center as the rotating center, the upper-row elastic terminals 151 and the lower-row elastic terminals 152 are overlapped; that is, the rotated upper-row elastic terminals 151 are arranged at the position of the original lower-row elastic terminals 152, and the rotated lower-row elastic terminals 152 are arranged at the position of the original upper-row elastic terminals 151. In other words, the upper-row elastic terminals 151 and the lower-row elastic terminals 152 are arranged upside down, and the arrangement sequence of the upper-row elastic terminals 151 are left-right reversal with respect to the arrangement sequence of the lower-row elastic terminals 152. The electrical plug connector 100 is inserted into the interior of the electrical receptacle connector 200 with a forward orientation for transmitting first signals; conversely, the electrical plug connector 100 is inserted into the interior of the electrical receptacle connector 200 with a reverse orientation for transmitting second signals. The specification for transmitting the first signals conforms to that for transmitting the second signals. Based on this, the inserting orientation of the electrical plug connector 100 is not limited, and can be forwarded or reversed, when plugging into the electrical receptacle connector 200.

Please refer to FIG. 4A, FIG. 4B and FIG. 4C again; in which embodiment positions of upper-row elastic terminals 151 correspond to those of the lower-row elastic terminals 152.

Please refer to FIG. 4 and FIG. 5, in which the metal shell 12 is hollowed. The metal shell 12 has an accommodating cavity 12*a* therein. The metal shell 12 encloses the insulation housing 11; that is, the insulation housing 11 is secured in the accommodating cavity 12*a*. In this embodiment, the metal shell 12 is formed by combining a plurality of frame structures, but embodiments are not limited thereto; in some implementation aspects, the metal shell 12 is formed by bending a unitary frame structure.

Please refer to FIG. 4 and FIG. 5, in which the circuit board 13 is disposed at a rear portion of the insulation housing 11. The circuit board 13 includes a plurality of grounding contacts 131 and a plurality of terminal contacts 132. The grounding contacts 131 and the terminal contacts 132 are disposed at one side of the circuit board 13, and the grounding contacts 131 are disposed at two sides of the terminal contacts 132.

Please refer to FIG. 4 and FIG. 5, in which the buckling members 14 are made by stamping or blanking techniques, but embodiments are not limited thereto; in some implementation aspects, the buckling members 14 are made by stamping techniques. The structural strength of the buckling member 14 made by blanking process is better than that resulting from stamping process. Each of the buckling members 14 is formed as an elongated plate. The buckling members 14 are respectively disposed at the two sides of the insulation housing 11. Each of the buckling members 14 includes a arm portion 141, a hook portion 142 and a soldering portion 143. The arm portions 141 are elongated and are assembled in the assembling spaces 115, respectively. An outer lateral side 145 of each arm portion 141 is exposed out of the assembling space 115 and connected to an inner lateral wall of the metal shell 12. The hook portion 142 is extended from a front portion of the arm portion 141 and extended toward the insertion cavity 113. The soldering portion 143 is extended from a rear portion of the arm portion 141 to pass through the rear portion of the assembling space 115 and exposed out of the insulation housing 11. The soldering portions 143 are extended to connect to the grounding contacts 131.

Figure 4D:
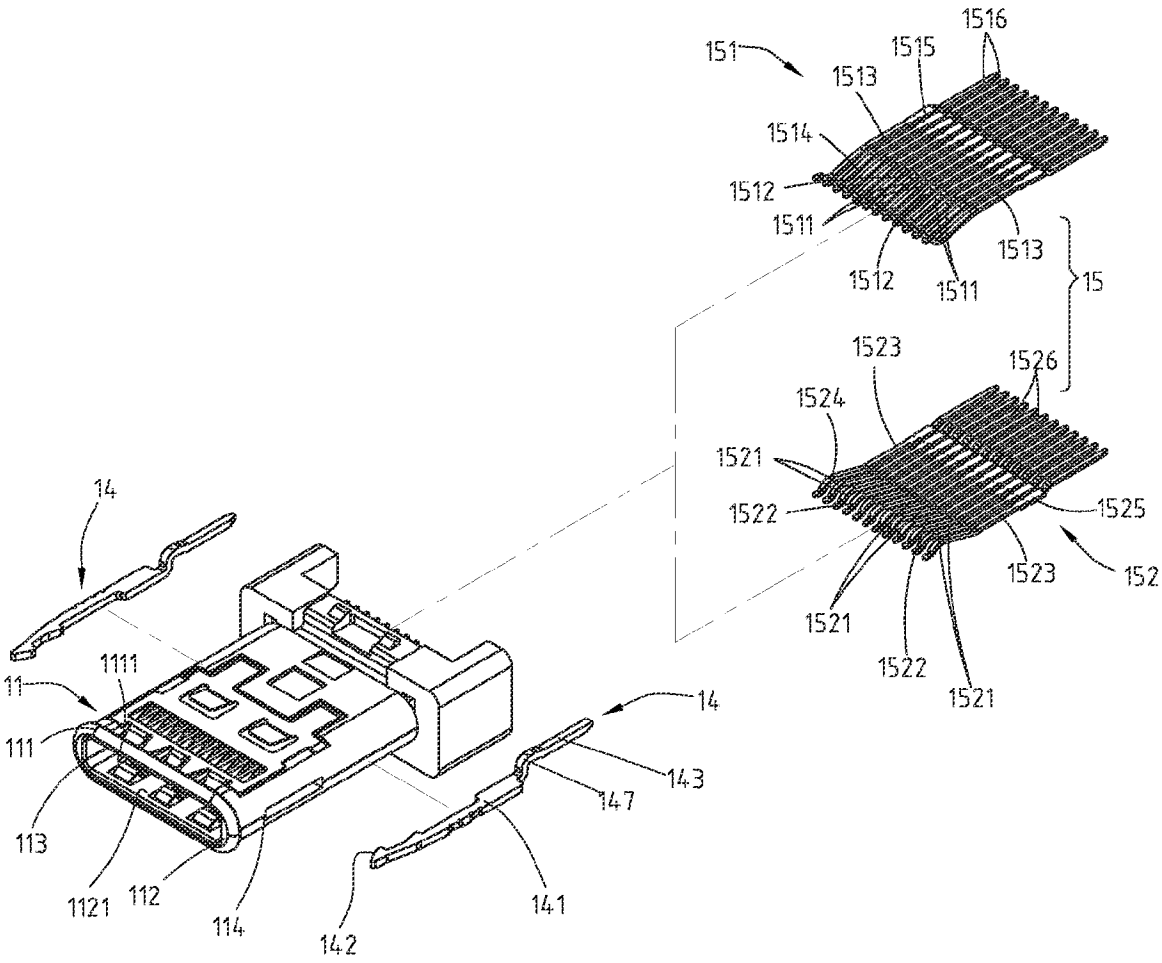
FIG. 4D is an exploded view of another first insulation housing of the electrical plug connector of the disclosure.

Please refer to FIG. 4D; in some implementation aspects, the insulation housing 11 is devoid of the assembling spaces 115; that is, in such embodiment, the lateral sides 114 of the insulation housing 11 are devoid of groove structures; namely, the aforementioned assembling spaces 115. Furthermore, in this embodiment, the arm portions 141 are combined to the lateral sides 114 of the insulation housing 11 upon integrally forming the insulation housing 11, thus the arm portions 141 are securely positioned to the lateral sides 114 of the insulation housing 11, so that the time for manufacturing the arm portions 141 can be omitted. That is, in this embodiment, the arm portions 141 are assembled on the raw material for molding the insulation housing 11 firstly, and then, by applying molding techniques, the arm portions 141 are embedded in the lateral sides 114 of the insulation housing 11. Here, the hook portion 142 is extended along a direction from the front portion of the arm portion 141 toward the insertion cavity 113; the soldering portion 143 is extended from the rear portion of the arm portion 141 to be exposed out of the insulation housing 11. Each of the soldering portions 143 is respectively extended to connect to the grounding contacts 131.

Figure 10:
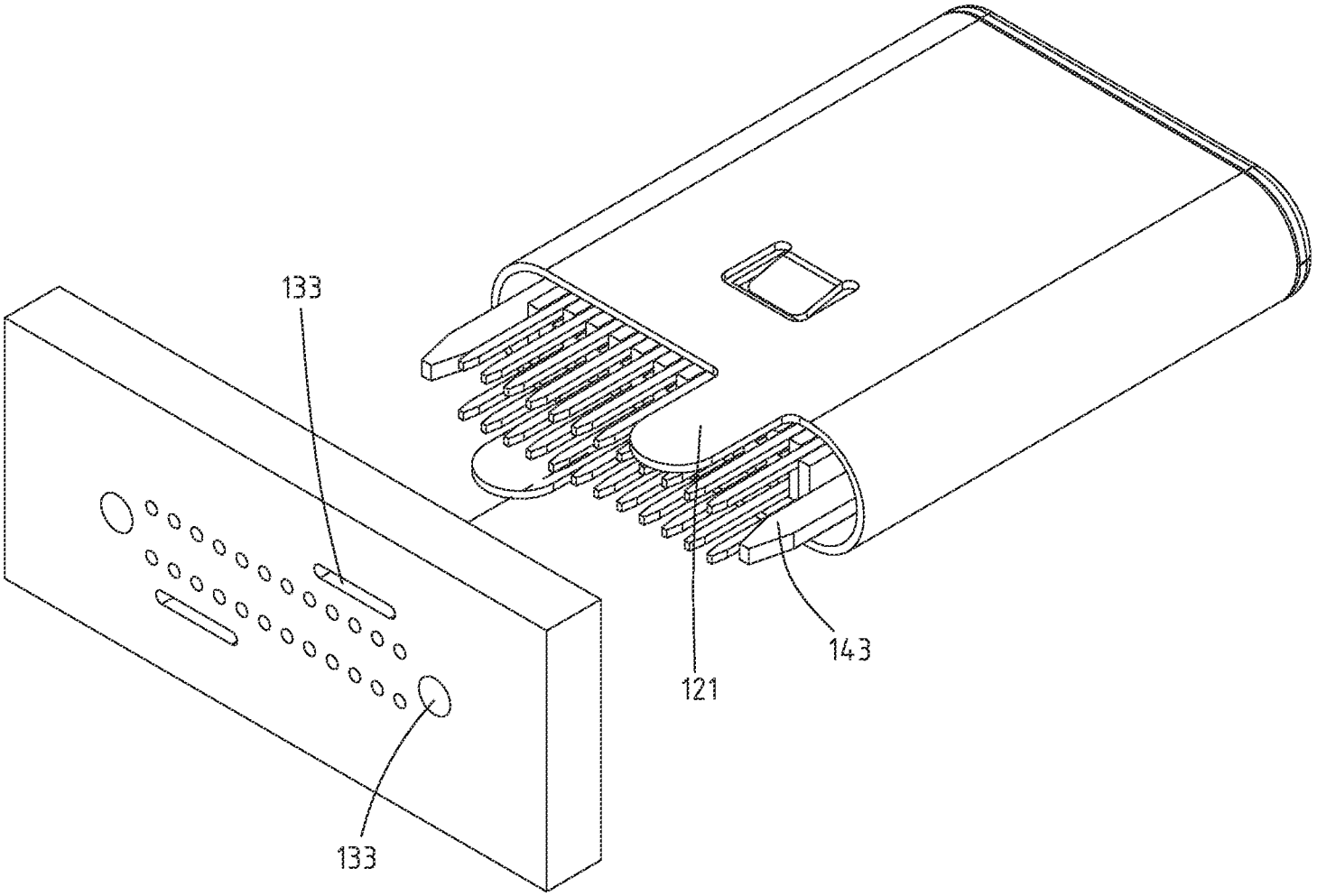
FIG. 10 is an exploded view of another electrical plug connector of the disclosure.

Please refer to FIG. 1 and FIG. 4, in which embodiment the circuit board 13 is parallel connected to the rear portion of the insulation housing 11, so that wires are developed from the circuit board 13 to allow the connector to be parts of a data transmission cable; alternatively, wires are omitted to allow the connector to be parts of a flash disk, but embodiments are not limited thereto. In some implementation aspects, the circuit board 13 is perpendicularly connected to the rear portion of the insulation housing 11; that is, the electrical plug connector 100 can be combined with the circuit board 13, so that the assembly between the insulation housing 11, the metal shell 12, and the circuit board 13 is formed as a standing-type charging docket, as shown in FIG. 10.

Please refer to FIG. 5 and FIG. 6, in which embodiment the grounding contacts 131 are assembled at a surface of the circuit board 13. The soldering portions 143 of the buckling members 14 are formed as horizontal soldering portions (called SMT pins, surface-mout technology pins) to be soldered on the grounding contacts 131, respectively, but embodiments are not limited thereto; in some implementation aspects, the soldering portions 143 of the buckling members 14 are formed as vertical soldering portions (through-hole pins), and the circuit board 13 further includes a plurality of through holes 133, the grounding contacts 131 are disposed at the through holes 133, respectively, as shown in FIG. 10; that is, the soldering portions 143 of the buckling members 14 are capable of being inserted into the through holes 133, respectively; next, soldering processes are applied to electrically connect the soldering portions 143 with the circuit board 13. Additionally, in some implementation aspects, the metal shell 12 further includes a plurality of soldering plates 121. The soldering plates 121 can be connected electrically to the circuit board 13 by means of horizontal soldering portions (SMT pins) or vertical soldering portions (through-hole pins). As shown in FIG. 10, the soldering plates 121 form vertical soldering portions (through-hole pins) for insertion into the through holes 133 to connect electrically with the circuit board 13.

Please refer to FIG. 2, in which embodiment each of the buckling members 14 further includes a buckling block 144. The buckling block 144 is a reversed protruded block structure; the buckling block 144 is respectively disposed at the arm portion 141. The insulation housing 11 further includes a plurality of buckling slots 116 disposed at the assembling spaces 115, respectively 113. The buckling blocks 144 are respectively secured in the buckling slots 114.

Please refer to FIG. 2 and FIG. 4, in which embodiment each of the buckling members 14 further includes an outer lateral side 145 and a contact region 146. The contact region 146 is disposed at the outer lateral side 145. After the buckling members 14 are respectively assembled in the assembling spaces 115 and the metal shell 12 is provided to enclose the insulation housing 11, the inner lateral wall of the metal shell 12 is connected to the contact regions 146, so that laser soldering is applied to combine the metal shell 12 with the contact regions 146; alternatively, each of contact regions 146 is formed as a protruded structure to contact the inner lateral wall of the metal shell 12; optionally, the inner lateral wall of the metal shell 12 includes a plurality of protruded structures contacted with the contact regions 146, respectively.

Please refer to FIG. 4 and FIG. 5; in which embodiment each of the buckling members 14 includes a bending portion 147 connected between the arm portion 141 and the soldering portion 143. The arm portion 141 and the soldering portion 143 are not at the same plane; that is, the soldering portions 143 are respectively aligned to match with the grounding contacts 131 of the circuit board 13 by the application of the bending portions 147.

Figure 7:
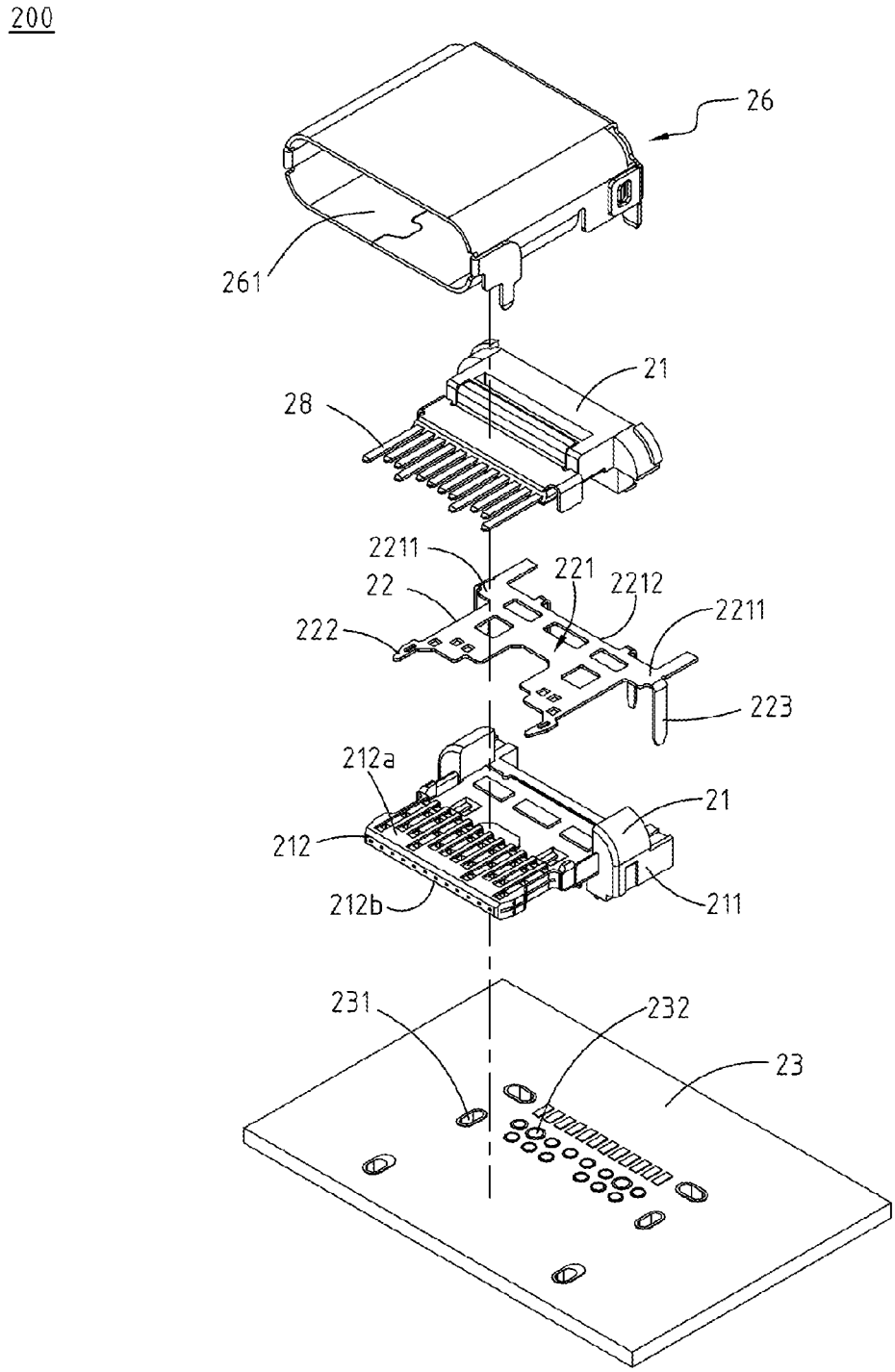
FIG. 7 is an exploded view (1) of an electrical receptacle connector of the disclosure.
Figure 7A:
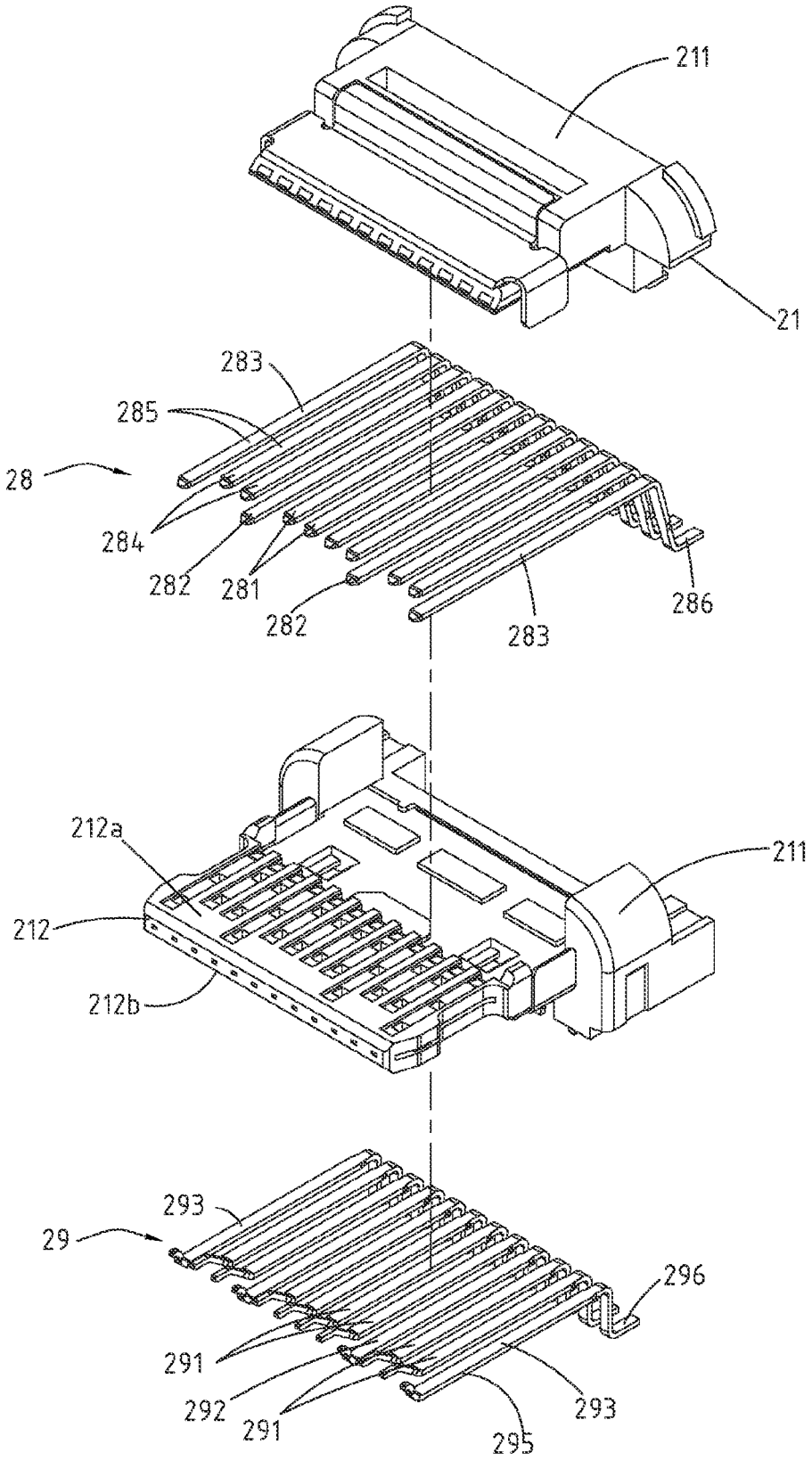
FIG. 7A is an exploded view (2) of the electrical receptacle connector of the disclosure while the metal shell is eliminated from the electrical receptacle connector.

Please refer to FIGS. 7 and 7A, in which the electrical receptacle connector 200 of the embodiment of the disclosure is illustrated. The electrical receptacle connector 200 is a USB type-C interface. Please refer to FIG. 1 to FIG. 3, in which the electrical receptacle connector 200 is provided to connect with the electrical plug connector 100. The electrical receptacle connector 200 includes an insulation housing 21, a plurality of upper-row and lower-row plate terminals 28 and 29, and a grounding sheet 22; and, a metal shell 26 is provided to enclose the insulation housing 21.

The metal shell 26 is hollowed and has a receiving cavity 261 therein. In this embodiment, the metal shell 26 is formed by, for example, a unitary or multi-piece member. Furthermore, the metal shell 26 defines an opening at one side thereof; the opening is formed in the shape of, for example, oblong or rectangular and communicates with the receptacle cavity 261 of the metal shell 26.

Please refer to FIG. 3 and FIG. 7; in which the insulation housing 21 is received in the receiving cavity 261 and insulation housing includes a base portion 211 and a tongue portion 212. Here, the base portion 211 and the tongue portion 212 are formed by insert-molding techniques, and the tongue portion 212 is extended from one side of the base portion 211. Furthermore, the tongue portion 212 has an upper surface 212*a* and a lower surface 212*b*.

The receptacle terminals 27 are disposed at the base portion 211 and the tongue portion 212. The receptacle terminals 27 include a plurality of upper-row plate terminals 28 and a plurality of lower-row plate terminals 29.

Please refer to FIG. 7A, FIG. 7B, FIG. 7C and FIG. 7D; in which the upper-row plate terminals 28 are disposed at the base portion 211 and the tongue portion 212. Here, the upper-row plate terminals 28 includes a plurality of upper-row plate signal terminals 281, at least one upper-row plate power-supply terminal 282 and at least one upper-row plate ground terminal 283. Each of the upper-row plate terminals 281 is disposed at the base portion 211 and the tongue portion 212 and located at the upper surface 212*a* of the tongue portion 212. Referring to FIG. 7D, the upper-row plate terminals 28 include, from left to right, an upper-row plate ground terminal 283 (Gnd), a first pair of differential signal terminals (TX1+−), a second pair of differential signal terminals (D+−), and a third pair of differential signal terminals (RX2+−) of the upper-row plate signal terminals 281, upper-row plate power-supply terminals 282 (Power/VBUS) between the three pairs of differential signal terminals, a retain terminal (RFU), (the retain terminal and a configuration channel 1 (CC1) are respectively arranged between the upper-row plate power-supply terminals 282 and the second pair of differential signal terminals of the upper-row plate signal terminals 281), and another upper-row plate ground terminal 283 (Gnd).

Please refer to FIG. 7A, FIG. 7B, FIG. 7C and FIG. 7D; in which each of the upper-row plate terminals 28 includes an upper-row contact section 284, an upper-row connecting section 285 and an upper-row soldering section 286. The upper-row connecting section 285 is disposed at the base portion 211 and the tongue portion 212. The upper-row contact section 284 is extended from one of two ends of the upper-row connecting section 285 and disposed at the upper surface 212*a* of the tongue portion 212, the upper-row soldering section 286 is extended from the other end of the upper-row connecting section 2855 and extended out of the base portion 211. The upper-row plate signal terminals 281 are disposed at the upper surface 212*a* and transmitting first signals (that is, USB 3.0 signals). And, the upper-row soldering section 286 is extended out of a bottom of the base portion 211. Furthermore, the upper-row soldering section 286 is bent horizontally to form horizontal soldering portions (SMT pins).

Figure 7B:
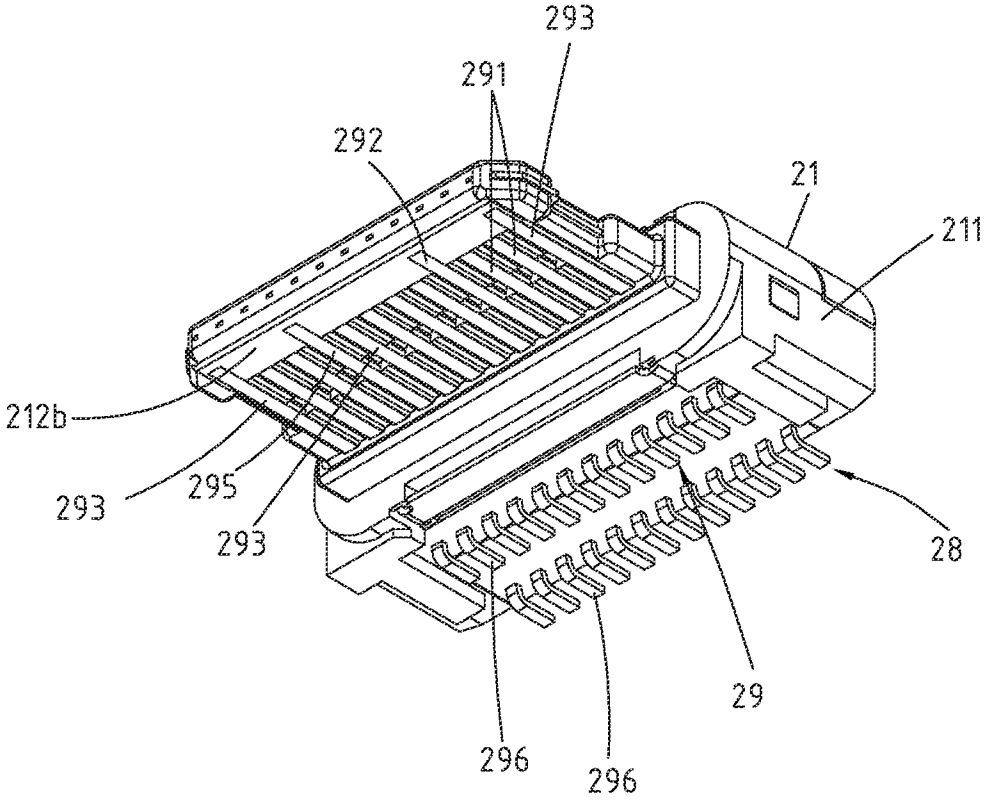
FIG. 7B is a perspective view of the electrical receptacle connector of the disclosure while the metal shell is eliminated from the electrical receptacle connector.
Figure 7C:
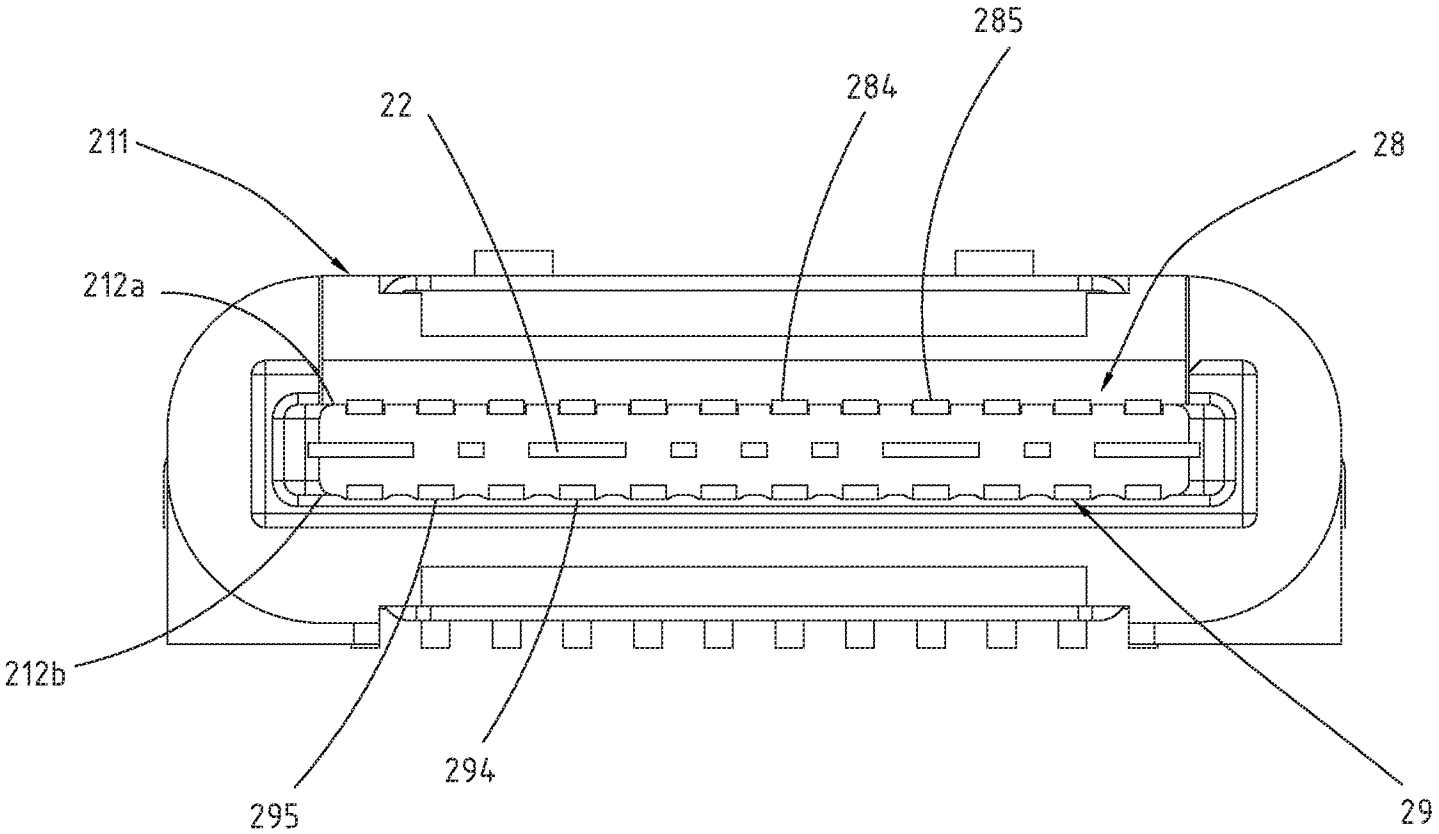
FIG. 7C is a lateral view of the electrical receptacle connector shown in FIG. 7B.

Please refer to FIG. 7A, FIG. 7B, FIG. 7C and FIG. 7D again; in which the lower-row plate terminals 29 are disposed at the base portion 211 and the tongue portion 212. Here, the lower-row plate terminals 29 includes a plurality of lower-row plate signal terminals 291, at least one lower-row plate power-supply terminal 292 and at least one lower-row plate ground terminal 293. Each of the lower-row plate terminals 29 is disposed at the base portion 211 and the tongue portion 212 and located at the lower surface 212*b* of the tongue portion 212. Refer to FIG. 7D, the lower-row plate terminals 29 include, from left to right, a lower-row plate ground terminal 293 (Gnd), a first pair of differential signal terminals (TX2+−), a second pair of differential signal terminals (D+−), and a third pair of differential signal terminals (RX1+−) of the lower-row plate signal terminals 291, lower-row plate power-supply terminals 292 (Power/VBUS) between the three pairs of differential signal terminals, a retain terminal (RFU), (the retain terminal and a configuration channel 2 (CC2) are respectively arranged between the lower-row plate power-supply terminals 292 and the second pair of differential signal terminals of the lower-row plate signal terminals 291), and another lower-row plate ground terminal 293 (Gnd).

Please refer to FIG. 7A, FIG. 7B, FIG. 7C and FIG. 7D again; in which each of the lower-row plate terminals 29 includes a lower-row contact section 294, a lower-row connecting section 295 and a lower-row soldering section 296. The lower-row connecting section 295 is disposed at the base portion 211 and the tongue portion 212. The lower-row contact section 294 is extended from one of two ends of the lower-row connecting section 295 and disposed at the lower surface 212*b*, and the lower-row soldering section 296 is extended from the other end of the lower-row connecting section 295 and extended out of the base portion 211. The lower-row plate signal terminals 291 are disposed at the lower surface 212*b* for transmitting second signals (that is, USB 3.0 signals). The lower-row soldering section 296 is extended out of the bottom the base portion 211. Furthermore, the lower-row soldering sections 296 are bent horizontally to be provided as SMT soldering portions, as shown in FIG. 7B.

Please refer to FIG. 7, FIG. 7A, FIG. 7B, FIG. 7C and FIG. 7D, in which embodiment the upper-row plate terminals 28 and the lower-row plate terminals 29 are respectively disposed at the upper surface 212*a* and lower surface 212*b* of the tongue portion 212. Furthermore, the upper-row plate terminals 28 and the lower-row plate terminals 29 are point-symmetrical with a central point of the receiving cavity 261 as the symmetrical center. Here, point-symmetry means, after the upper-row plate terminals 28 (or the lower-row plate terminals 29) are rotated by 180 degrees with the symmetrical center as the rotating center, the upper-row plate terminals 28 and the lower-row plate terminals 29 are overlapped; that is, the rotated upper-row plate terminals 28 are arranged at the position of the original lower-row plate terminals 29, and the rotated lower-row plate terminals 29 are arranged at the position of the original upper-row plate terminals 28. In other words, the upper-row plate terminals 28 and the lower-row plate terminals 29 are arranged upside down, and the arrangement sequence of the upper-row plate terminals 28 are left-right reversal with respect to the arrangement sequence of the lower-row plate terminals 29. The electrical plug connector 100 is inserted into the interior of the electrical receptacle connector 200 with a forward orientation for transmitting first signals; conversely, the electrical plug connector 100 is inserted into the interior of the electrical receptacle connector 200 with a reverse orientation for transmitting second signals. The specification for transmitting the first signals conforms to that for transmitting the second signals. Based on this, the inserting orientation of the electrical plug connector 100 is not limited, and can be forwarded or reversed, when plugging into the electrical receptacle connector 200.

Please refer to FIG. 7A, FIG. 7B, FIG. 7C and FIG. 7D again; in which embodiment positions of upper-row plate terminals 28 correspond to those of the lower-row plate terminals 29.

The grounding sheet 22 is disposed at the insulation housing 21. The grounding sheet 22 includes a main body 221, a plurality of buckles 222 and a plurality of soldering portions 223. The main body 221, the buckles 222 and the soldering portions 223 are connected with each other. The main body 221 is formed at the insulation housing 21. The buckles 222 are disposed at two sides of the main body 221 to be exposed out of two sides of the tongue plate 211, respectively; that is, the buckles 222 are protruded from the two sides of the tongue plate 211. The buckles 222 are respectively connected to the hook portions 142. Additionally, the soldering portions 223 are extended to form at a rear portion of the main body 221. Here, the soldering portions 223 are extended downwardly from two lateral portions 2211 and a rear portion 2212 of the main body 221, respectively. The soldering portions 223 are exposed out of the insulation housing 21 to connect to a circuit board 23. The soldering portions 223 are disposed at the rear portion of the main body 221 and downwardly extended to form the vertical soldering portions (through-hole pins). The circuit board 23 includes a plurality of grounding contacts 231 and a plurality of through holes 232. The grounding contacts 231 are disposed at the through holes 232, respectively. The soldering portions 223 are respectively inserted into the through holes 232 for applying soldering processes, thereby respectively connecting the soldering portions 223 with the grounding contacts 231.

When the electrical plug connector 100 is inserted into the interior of the electrical receptacle connector 200, the hook portions 142 of the buckling members 14 of the electrical plug connector 100 is buckled with the buckles 222, thereby avoiding the hook portions 142 of the electrical plug connector 100 rubbing against the two sides of the tongue plate 211 to wear the tongue plate 211. Furthermore, the soldering portions 223 are exposed out of the insulation housing 21 and connected to the metal shell 26, so as to conduct the grounding sheet 22 for grounding.

Figure 8:
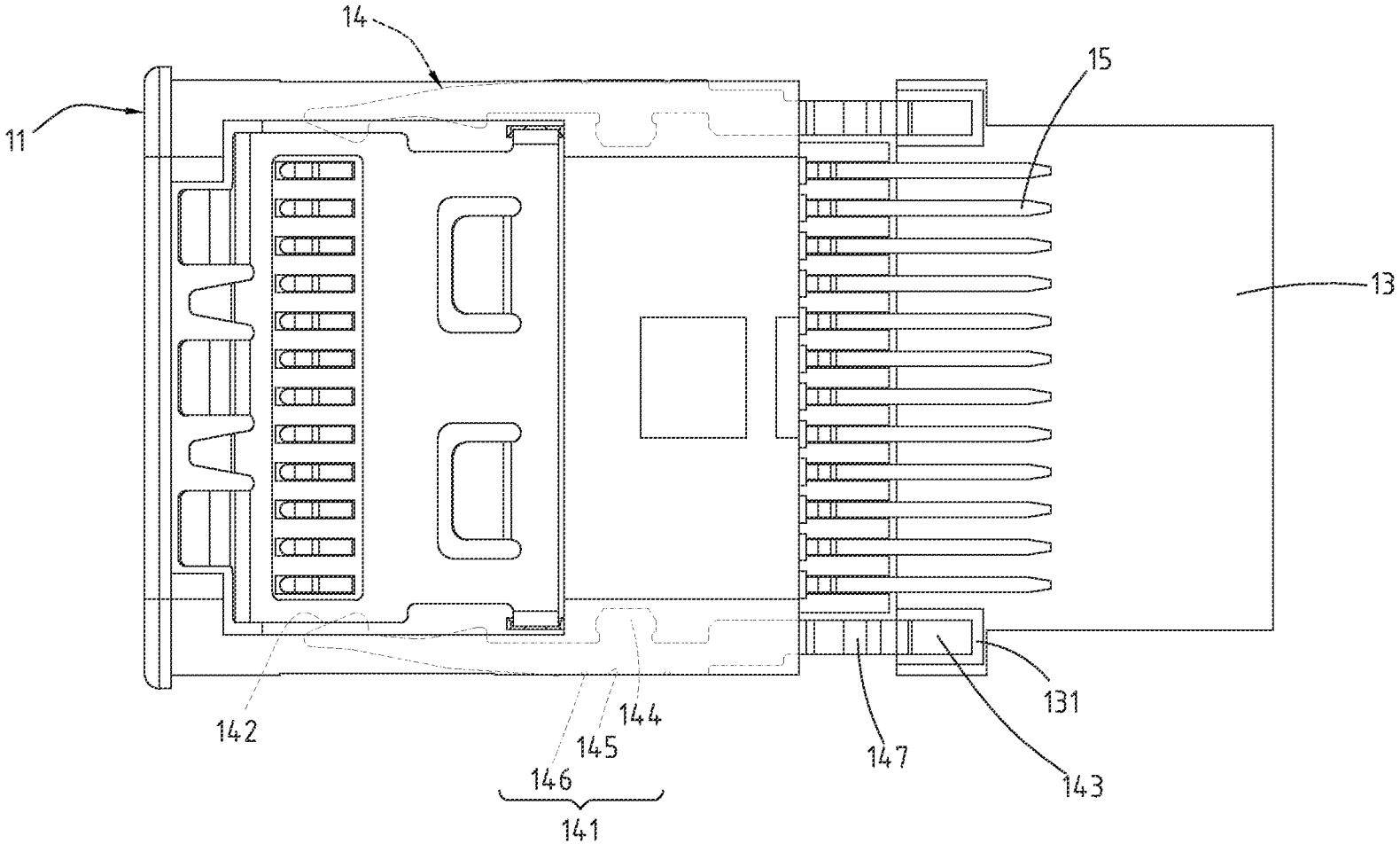
FIG. 8 is a top view of the electrical plug connector of the disclosure.
Figure 9:
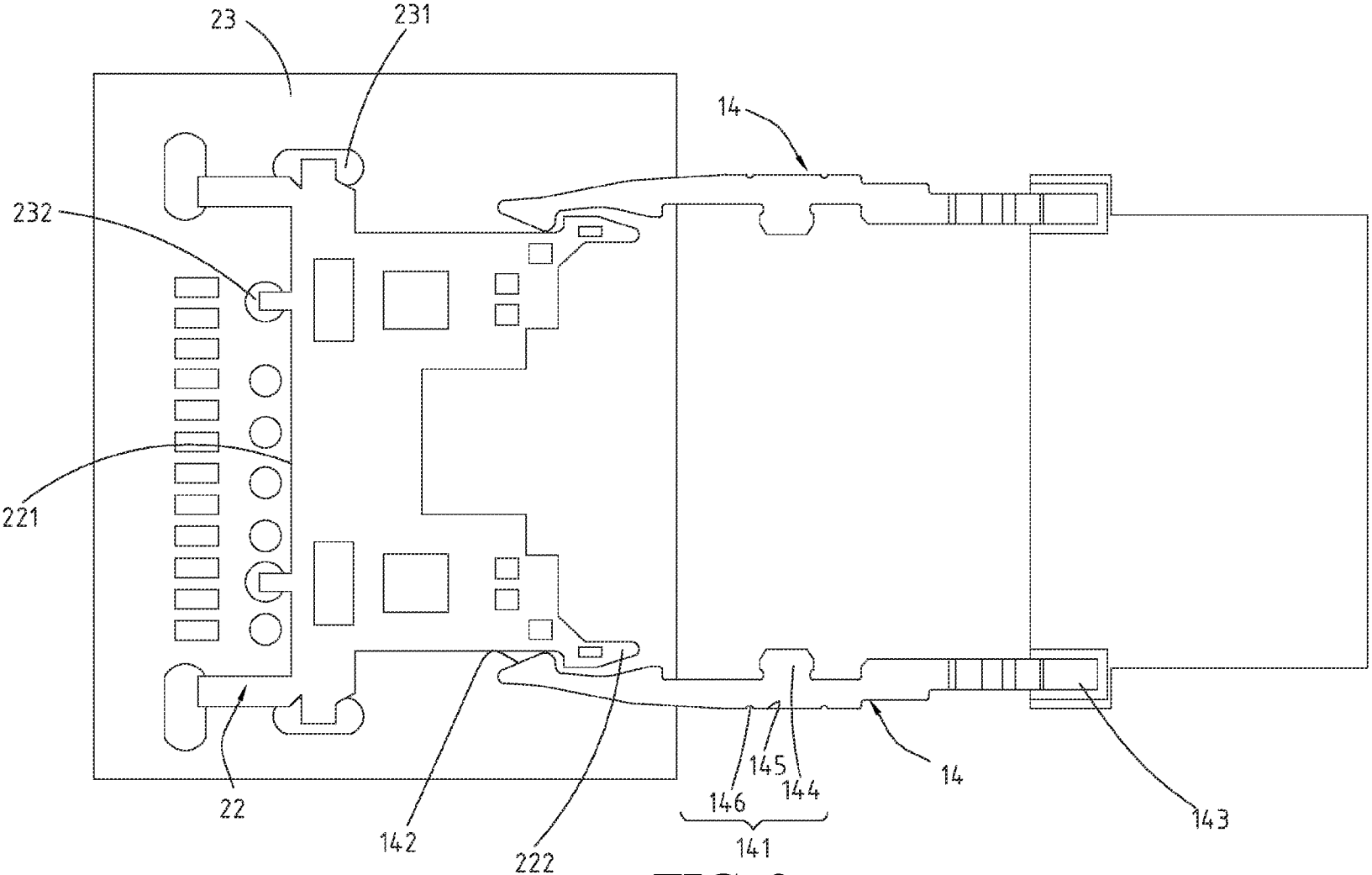
FIG. 9 is a schematic view showing the buckling members of the electrical plug connector are connected to a grounding sheet of the electrical receptacle connector.

Additionally, when the electrical plug connector 100 is inserted into the interior of the electrical receptacle connector 200, the hook portions 142 of the buckling members 14 of the electrical plug connector 100 are respectively connected to the buckles 222 of the grounding sheet 22 of the electrical receptacle connector 200, as shown in FIG. 3, FIG. 8 and FIG. 9. In the electrical plug connector 100, the arm portions 141 of the buckling members 14 are connected to the metal shell 12 and the soldering portions 143 of the buckling member 14 are connected to the circuit board 13; while in the electrical receptacle connector 200, the soldering portions 223 of the grounding sheet 22 are connected to the circuit board 23. Based on this, low-impedance grounding path is provided, and the electromagnetic interference (EMI) and radio frequency interference (RFI) can be improved.

As described previously, in the electrical plug connector of the disclosure, the arm portions are connected to the metal shell, and the soldering portions of the buckling members are connected to one circuit board; while in the electrical receptacle connector of the disclosure, the soldering portions of the grounding sheet are connected to another circuit board. Consequently, low-impedance grounding path can be provided upon the electrical plug connector is connected with the electrical receptacle connector, thereby reducing the EMI and RMI problems. Additionally, the soldering portions of the buckling members are soldered on the circuit board to provide the structural strength of the buckling members. Additionally, because the upper-row terminals and the lower-row terminals are arranged upside down, and the arrangement sequence of the upper-row plate contacts are left-right reversal with respect to the arrangement sequence of the lower-row plate contacts, an electrical plug connector is inserted into the interior of the electrical receptacle connector with the terminals of the electrical plug connector contacting with the upper-row plate contacts when plugged in a forward orientation, and the electrical plug connector is inserted into the interior of the electrical receptacle connector with the terminals of the electrical plug connector contacting with the lower-row plate contacts when plugged in a reverse direction. Consequently, the inserting orientation of the electrical plug connector is not limited.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical plug connector, comprising:

a first metal shell, comprising an accommodating cavity;

a first insulation housing, disposed in the accommodating cavity, wherein the first insulation housing comprises an upper portion, a lower portion, and two lateral sides, an insertion cavity is defined between the upper portion and the lower portion, the lateral sides are disposed at two sides of the first insulation housing, and two assembling spaces are respectively formed on the lateral sides of the first insulation housing;

a plurality of upper-row elastic terminals, comprising a plurality of upper-row elastic signal terminals, at least one upper-row elastic power-supply terminal and at least one upper-row elastic ground terminal, wherein each of the upper-row elastic terminals is disposed at the first insulation housing and located at a lower surface of the upper portion;

a plurality of lower-row elastic terminals, comprising a plurality of lower-row elastic signal terminals, at least one lower-row elastic power-supply terminal and at least one lower-row elastic ground terminal, wherein each of the lower-row elastic terminals is disposed at the first insulation housing and located at an upper surface of the lower portion; and two buckling members, disposed at the first insulation housing, wherein each of the buckling members comprises:

an arm portion, disposed in the lateral side of the first insulation housing, wherein the arm portion is received in the assembling space, and an outer lateral sides of the arm portion is exposed out of the first insulation housing laterally to contact an inner wall of the metal shell;

a hook portion, extended from a front portion of the arm portion toward the insertion cavity; and a first soldering portion, extended from a rear portion of the arm portion to be exposed out of the first insulation housing and to be connected to a first circuit board, wherein the first circuit board is disposed at a rear portion of the first insulation housing.

2. The electrical plug connector according to claim 1, wherein the first soldering portion is extended from the arm portion and exposed out of the assembling space.

3. The electrical plug connector according to claim 2, wherein each of the buckling members comprises a buckling block disposed at the arm portion, the first insulation housing comprises a plurality of buckling slots respectively disposed at the assembling spaces, the buckling blocks are respectively secured in the buckling slots.

4. The electrical plug connector according to claim 1, wherein the contact regions are disposed at the outer lateral sides of the arm portions to be electrically or mechanically contacted the inner wall of the metal shell.

5. The electrical plug connector according to claim 1, wherein each of the buckling members comprises a bending portion connected between the arm portion and the first soldering portion.

6. The electrical plug connector according to claim 1, wherein the arm portions are made by stamping or blanking process.

7. The electrical plug connector according to claim 1, wherein each of the upper-row elastic terminals comprises an upper-row contact section, an upper-row connecting section and an upper-row soldering section, the upper-row connecting section is disposed on the upper portion, the upper-row contact section is extended from one of two ends of the upper-row connecting section and located at the lower surface of the upper portion, and the upper-row soldering section is extended from the other end of the upper-row connecting section and extended out of the first insulation housing.

8. The electrical plug connector according to claim 1, wherein each of the lower-row elastic terminals comprises a lower-row contact section, a lower-row connecting section and a lower-row soldering section, the lower-row connecting section is disposed on the lower portion, the lower-row contact section is extended from one of two ends of the lower-row connecting section and located at the upper surface of the lower portion, and the lower-row soldering section is extended from the other end of the lower-row connecting section and extended out of the first insulation housing.

9. The electrical plug connector according to claim 1, wherein the upper-row elastic signal terminals are located at the upper surface for transmitting first signals, and the lower-row elastic signal terminals are located at the lower surface for transmitting second signals, the specification for transmitting the first signals conforms to the specification for transmitting the second signals, the upper-row elastic terminals and the lower-row elastic terminals are point-symmetrical with a central point of the accommodating cavity as the symmetrical center.

10. The electrical plug connector according to claim 9, wherein the position of the upper-row elastic terminals correspond to the position of the lower-row elastic terminals.

11. An electrical plug connector comprising:

a first metal shell, comprising an accommodating cavity;

a first insulation housing, disposed in the accommodating cavity, wherein the first insulation housing comprises an upper portion, a lower portion, and two lateral sides, an insertion cavity is defined between the upper portion- and the lower portion, and the lateral sides are disposed at two sides of the first insulation housing;

a plurality of upper-row elastic terminals, comprising a plurality of upper-row elastic signal terminals, at least one upper-row elastic power-supply terminal and at least one upper-row elastic ground terminal, wherein each of the upper-row elastic terminals is disposed at the first insulation housing and located at a lower surface of the upper portion;

a plurality of lower-row elastic terminals, comprising a plurality of lower-row elastic signal terminals, at least one lower-row elastic power-supply terminal and at least one lower-row elastic ground terminal, wherein each of the lower-row elastic terminals is disposed at the first insulation housing and located at an upper surface of the lower portion;

a plurality of buckling member, disposed at the first insulation housing, each of the buckling members comprising:

an arm portion, disposed in the lateral side of the first insulation housing;

a hook portion, extended from a front portion of the arm portion toward the insertion cavity; and a first soldering portion, extended from a rear portion of the arm portion to be exposed out of the first insulation housing; and a first circuit board disposed at a rear portion of the first insulation housing, wherein the first circuit board comprises a plurality of first grounding contacts, the first soldering portions are extended to connect to the first grounding contacts, and the first circuit board is arranged parallel or perpendicular to the first insulation housing.

12. The electrical plug connector according to claim 11, wherein the first circuit board comprises a plurality of through holes, the first grounding contacts are respectively disposed at the through holes.

13. The electrical plug connector according to claim 11, wherein the first metal shell comprises a plurality of soldering plates respectively connected to the first grounding contacts.

14. An electrical receptacle connector, provided for being inserting by the electrical plug connector, the electrical receptacle connector comprising:

a second metal shell, comprising a receiving cavity;

a second insulation housing, disposed in the receiving cavity, the second insulation housing comprising a base portion and a tongue portion extended from one side of the base portion, the tongue portion comprising an upper surface and a lower surface;

a plurality of upper-row plate terminals, comprising a plurality of upper-row plate signal terminals, at least one plate power-supply terminal and at least one plate ground terminal, each of the upper-row plate terminals being disposed at the base portion and the tongue portion and located at the upper surface;

a plurality of lower-row plate terminals, comprising a plurality of lower-row plate signal terminals, at least one plate power-supply terminal and at least one plate ground terminal, each of the lower-row plate terminals being disposed at the base portion and the tongue portion and located at the lower surface; and a grounding sheet, disposed at the second insulation housing, the grounding sheet comprising:

a main body, disposed at the tongue portion;

a plurality of buckles, disposed at two sides of the main body to be exposed out of two sides of the tongue portion, wherein the buckles of the grounding sheet are receptively provided for contacting with the hook portions of the buckling members of the electrical plug connector; and a plurality of second soldering portions extended downwardly from two lateral portions and a rear portion of the main body, respectively, and to be connected to a second circuit board, wherein the second circuit board is disposed at a rear portion of the second insulation housing.

15. The electrical receptacle connector according to claim 14, wherein the second circuit board comprises a plurality of second grounding contacts respectively connected to the second soldering portions.

16. The electrical receptacle connector according to claim 14, wherein each of the upper-row plate terminals comprises an upper-row contact section, an upper-row connecting section and an upper-row soldering section, the upper-row connecting section is disposed at the base portion and the tongue portion, the upper-row contact section is extended from one of two ends of the upper-row connecting section and located at the upper surface of the tongue portion, and the upper-row soldering section is extended from the other end of the upper-row connecting section and extended out of the base portion.

17. The electrical receptacle connector according to claim 14, wherein each of the lower-row plate terminals comprises a lower-row contact section, a lower-row connecting section and a lower-row soldering section, the lower-row connecting section is disposed at the base portion and the tongue portion, the lower-row contact section is extended from one of two ends of the lower-row connecting section and located at the lower surface of the tongue portion, and the lower-row soldering section is extended from the other end of the lower-row connecting section and extended out of the base portion.

18. The electrical receptacle connector according to claim 14, wherein the upper-row plate signal terminals are located at the upper surface for transmitting first signals, and the lower-row plate signal terminals are located at the lower surface for transmitting second signals, the specification for transmitting the first signals conforms to the specification for transmitting the second signals, the upper-row plate terminals and the lower-row plate terminals are point-symmetrical with a central point of the receiving cavity as the symmetrical center.

19. The electrical plug connector according to claim 18, wherein the position of the upper-row plate terminals correspond to the position of the lower-row plate terminals.

* * * * *